US006185823B1

(12) United States Patent
Brown et al.

(10) Patent No.: US 6,185,823 B1
(45) Date of Patent: Feb. 13, 2001

(54) OVAL FRAME RAZOR

(75) Inventors: Frank Edward Brown, Maidenhead; Brian Oldroyd, Reading, both of (GB)

(73) Assignee: The Gillette Company, Boston, MA (US)

( * ) Notice: Under 35 U.S.C. 154(b), the term of this patent shall be extended for 0 days.

(21) Appl. No.: 09/063,842

(22) Filed: Apr. 21, 1998

Related U.S. Application Data

(63) Continuation of application No. PCT/US96/18192, filed on Nov. 8, 1996.

(30) Foreign Application Priority Data

Nov. 10, 1995 (GB) ..... 9523040

(51) Int. Cl.[7] ..... B26B 21/00

(52) U.S. Cl. ..... 30/50; 30/84; 30/77; 30/76

(58) Field of Search ..... 30/77, 41, 50, 30/49, 47, 34.2, 41.5, 51, 74.1, 78, 79, 84; D28/47, 1

(56) References Cited

U.S. PATENT DOCUMENTS

| | | | | |
|---|---|---|---|---|
| 330,418 | | 11/1885 | Partridge et al. . | |
| D. 373,218 | | 8/1996 | Shurtleff et al. | D28/47 |
| D. 403,811 | * | 1/1999 | Brown et al. | 28/47 |
| D. 415,315 | | 10/1999 | Swanson et al. | D28/47 |
| 951,036 | * | 3/1910 | Waterman | 30/49 |
| 1,342,028 | | 6/1920 | Nordskog . | |
| 1,744,280 | * | 1/1930 | Peterson | 30/41 |
| 1,768,307 | | 6/1930 | Bleloch et al. | 30/81 |

(List continued on next page.)

FOREIGN PATENT DOCUMENTS

| | | | | |
|---|---|---|---|---|
| 509 715 | | 8/1953 | (BE) . | |
| 319 832 | | 4/1920 | (DE) . | |
| 87 17 729 U | | 10/1989 | (DE) | B26B/21/14 |
| 0 453 906 | | 4/1991 | (EP) | B26B/21/44 |
| 0 477 132 | | 3/1992 | (EP) | B26B/21/40 |
| 482 302 | | 3/1917 | (FR) . | |
| 806 899 | | 12/1936 | (FR) . | |
| 1503887 | | 2/1968 | (FR) . | |
| 21940 | * | 4/1913 | (GB) | 30/49 |
| 409902 | * | 5/1934 | (GB) | 30/49 |
| 4-361783 | | 12/1992 | (JP) | B26B/21/22 |
| WO91/01204 | * | 2/1991 | (WO) | 30/49 |
| WO 96/02369 | | 2/1996 | (WO) | B26B/21/14 |

OTHER PUBLICATIONS

PCT Search Report dated Apr. 18, 1997 in corresponding PCT International application PCT/US96/18192 with examiner's indication of relevance of its foreign references in English.

*Primary Examiner*—Rinaldi I. Rada
*Assistant Examiner*—Omar Flores-Sanchez
(74) *Attorney, Agent, or Firm*—Edward S. Podszus

(57) ABSTRACT

A razor blade unit for a safety razor has optimised shape and dimensions for body shaving, especially the regions of the axillae. The blade unit has an elongate blade with a rectilinear sharpened edge, and a skin contacting surface at which the length is 1 to 4 times the width and not greater than 60 mm, preferably 40 to 45 mm. The skin contacting surface has a footprint area of at least 450 $mm^2$, preferably 600 to 750 $mm^2$, and a circularity which is not less than the lower of (i) 64%, and (ii) the circularity of a rectangle with the same length and width as the skin contacting surface and with corner radii of 30% of the width. In a plane perpendicular to the blade edge the skin contacting surface is convex and shaped to make at least three point contact with an imaginary circumscribing circle with a radius of 15 to 70 mm, preferably 25 mm. Guard and cap surfaces in front of and behind the blade edge each have a skin contact area of at least 140 $mm^2$, and their combined areas is preferably at least 400 $mm^2$, e. g. 450 to 500 $mm^2$. A preferred shape is rectangular with semi-circular ends.

42 Claims, 10 Drawing Sheets

U.S. PATENT DOCUMENTS

| | | | | |
|---|---|---|---|---|
| 2,183,554 | | 12/1939 | Evans | 30/84 |
| 3,477,127 | * | 11/1969 | Regan | 30/41 |
| 3,934,338 | * | 1/1976 | Braginetz | 30/47 |
| 4,314,404 | | 2/1982 | Ruiz et al. | 30/41 |
| 4,875,288 | | 10/1989 | Trotta et al. . | |
| 4,964,214 | | 10/1990 | Welsh et al. | 30/49 |
| 4,977,670 | * | 12/1990 | Iten | 30/49 |
| 4,984,365 | | 1/1991 | Leonard et al. | 30/34.05 |
| 5,031,317 | | 7/1991 | Jacobson | 30/49 |
| 5,063,669 | * | 11/1991 | Althaus | 30/77 |
| 5,084,968 | | 2/1992 | Trotta | 30/47 |
| 5,161,307 | | 11/1992 | Althaus | 30/77 |
| 5,191,712 | | 3/1993 | Cook et al. | 30/34.2 |
| 5,249,361 | | 10/1993 | Apprille, Jr. et al. | 30/77 |
| 5,369,885 | * | 12/1994 | Ferraro | 30/41 |
| 5,463,813 | * | 11/1995 | Otsuka et al. | 30/49 |
| 5,604,983 | | 2/1997 | Simms et al. | 30/49 |
| 5,903,979 | * | 5/1999 | Oldroyd | 30/50 |

* cited by examiner

OVAL FRAME RAZOR

This application is a continuation of International Application No. PCT/US96/18192, with an international filing date of Nov. 8, 1996.

BACKGROUND OF THE INVENTION

This invention relates to safety razors of the kind having a blade unit carried by a handle, the blade unit including an elongate blade with a rectilinear sharpened edge, or a plurality of such blades with parallel edges. The blade unit may be fixedly mounted on the handle with the intention that the entire razor be discarded when the blade edge or edges have become dulled. Alternatively, the blade unit can be detachably connected to the handle to enable replacement of a used blade unit with a fresh blade unit. Replaceable blade units are commonly referred to as cartridges.

SUMMARY OF THE INVENTION

There has been a general tendency over recent years for razor blade units to have been reduced in size, especially regarding the area of the surfaces which contact the skin around the blades during shaving, and the majority of blade units currently available in the marketplace are long and narrow with substantially rectangular configurations as viewed in a direction substantially perpendicular to the skin contacting surfaces. On the whole razor blade units of such shape and size have been found to provide an enhanced shaving performance in comparison with earlier blade units of larger dimensions.

The present invention is aimed specifically at a blade unit for body shaving, primarily in the axillary area. There are already on the market razors intended for use by ladies who do commonly shave their axillae, and like other razors there has been a strong trend towards making the blade units of these female razors with a narrow rectangular configuration as mentioned above. It has become the accepted thinking within the art that such blade units of narrow dimensions are especially beneficial for shaving the axillae since they will more readily fit into the rather deep concave socket of the axilla.

The present invention makes a significant departure from this current thinking in the shaving field and goes directly against all recent developments in this technical area as regards blade unit dimensions. Surprisingly, and contrary to all expectations, shaving tests have shown that not only can a blade unit of relatively large dimensions at least equal the shaving effectiveness of the smaller prior art blade units when shaving the axillae, but large blade units can be shaped to conform to the axilla region of the body so that shaving performance is not diminished, and that in terms of overall comfort large blade units have a superior performance to the prior art blade units and are preferred by users. It appears the added stability given by a large contact area with the skin gives the user greater confidence when shaving the axilla which cannot be viewed very easily during the shaving process, and as a consequence an improved comfort is perceived by the user and this more than counteracts any loss of performance due to the large contact area.

For most adult females, the underarm cavity has a minimum radius of curvature of about 25 to 30 mm. Therefore, a razor blade unit according to the invention has a length not greater than 60 mm, preferably not greater than 50 mm, and a length in the range of 40 to 45 mm is preferred. The width of the blade unit is preferably such that the aspect ratio, namely the ratio of the overall length to the overall width measured perpendicular to the blade, is in the range of 1 to 4, and in most of the preferred embodiments of the invention the aspect ratio is from 1.5 to 2.8, and more precisely in the range of 2.0 to 2.5. In the preferred embodiments the width of the blade unit is in the range of 12 to 23 mm, in particular 15 to 20 mm. Guard and cap surfaces are defined in front of and behind the blade or blades for contact with the skin in front of and behind the blade or blades during shaving, and preferably each of the guard and cap surfaces has a width of not less than 4.0 mm, at least where the width of the blade unit is at a maximum. The guard and cap each has a skin contact area which is preferably not less than 140 $mm^2$, and the combined skin contact areas of the cap and guard are preferably at least 400 $mm^2$, and most preferably in the range of 450 to 500 $mm^2$. As the blade unit of the present invention is rather wide, in order to facilitate contact with the skin in the axilla over at least most of the guard and cap areas, as viewed in cross section in a plane perpendicular to the blade edges, the skin contacting surface is made convex. It is important to understand that the word "convex" as used in the present specification does not necessarily mean that the skin contacting surface is smoothly curved and it implies only that the guard and cap surfaces extend upwardly in the direction from their edges remote from the blade or blades so that the blade edge or edges are at a level above the remote edges of the cap and guard surfaces. More particularly, a straight line joining the outer and inner limits of each of the guard and cap surfaces is inclined at an angle of at least 5°, and possibly up to 25°, to a plane which is tangential to the skin contacting surfaces immediately in front of and behind the blades. In the preferred embodiments the angle of inclination is in the range of 10 to 20 degrees, and more specifically substantially equal to 15°. By virtue of the convexity of the skin contacting surface, the blade unit is preferably shaped to make at least three point contact with an imaginary circumscribing circle having a diameter of from 30 to 100 mm, and preferably of about 50 mm whereby it will be ensured that the blade unit convexity will at least approximately conform to that of the axilla.

An important aspect of the blade unit according to the invention is that it defines a large area over which contact can be made with the skin during shaving, and a circumscribing perimeter extending about the skin contacting surface confines an area, referred to hereinafter as the "footprint area", of at least 450 $mm^2$. The most preferred footprint area is in the range of 600–750 $mm^2$, and more specifically between 650 and 720 $mm^2$.

Since the invention proposes a blade unit with a long and wide shape, a substantially rectangular configuration with sharp angled corners, at least at the edge adjacent the guard surface, is inappropriate. For the purposes of the present specification a sharp angled corner may be considered to be an angle less than about 120° with a radius of curvature less than around 3 mm. Preferably the curvature at any corner is at least 5 mm. The unacceptability of a substantially rectangular configuration and the objective of providing a large skin contact area means that the blade unit needs to be profiled, as seen in plan generally perpendicular to the skin contacting area, to obtain a relatively large area within the confines of the overall length and width dimensions. The "circularity" of a two dimensional shape is a convenient way of relating the area enclosed by its perimeter to the length of the perimeter, and expressing it in terms of a percentage compared with a circle which always provides the maximum area for any given perimeter length. Thus, the circularity for any shape is defined by the equation:

$$\text{circularity} = \frac{A}{P^2} \times 4\pi \times 100$$

where $A$ = the area $P$ = the perimeter

Razor blade units according to the present invention have a circularity not less than the lower of (a) 65%, and (b) the circularity of a substantially rectangular area having the same length and width as the skin contacting area and having corner radii of 30% of said width. Preferably the circularity is greater than that of a rectangle with the same overall length and width and rounded corners with radii equal to 10% of the length. For blade units with a low aspect ratio, i.e. less than about 3, the lower limit (a) will apply, although even in the case of these blade units it is preferable that the circularity also exceeds limit (b). Acceptable oval blade units with an aspect ratio above 3.25 may have a circularity of less than 65%. Preferred embodiments with aspect ratios below about 2.75 have a circularity greater than 70%, and more particularly in the order of 80%. Typical prior art blade units have a circularity of less than 65%. The comparatively large circularity of a blade unit according to the invention can be achieved with rounded corners at the ends of the blade unit with relatively large radii of curvature of at least 6 mm, or with oval, elliptical or polygonal shapes which need not necessarily be symmetrical.

Having regard to the foregoing, the present invention resides in a razor blade unit comprising at least one elongate blade having a rectilinear sharpened edge and mounted in a substantially inflexible carrier, a skin contacting surface surrounding the blade edge(s) and including guard and cap surfaces on opposite sides of the blade edge(s), the aspect ratio of the length to width of the skin contacting surface being in the range of from 1 to 4, as seen in cross section in a plane perpendicular to the blade edge(s) the skin contacting surface being convex, the overall length of the blade unit at the skin contacting surface being not greater than 60 mm, the skin contacting surface having a circumscribing perimeter confining a footprint area of at least 450 $mm^2$, and the circumscribing perimeter being so shaped that the footprint area confined by said perimeter has a circularity (as herein above defined) not less than the lower of (a) 65%, and (b) the circularity of a substantially rectangular area having the same length and width as the footprint area of the skin contacting surface and having corner radii of 30% of said width, and the edge of the blade unit adjacent the guard surface being free of sharp angled corners.

A razor equipped with a blade unit as described above has been found in shave tests to achieve a significantly improved overall performance in shaving the axilla and has also been found to be very effective in shaving other body areas, such as the legs.

It should be understood that unless otherwise stated, all dimensions and areas quoted herein are measured in a projected plane and as seen in plan view so the effect of the convex curvature of the skin contacting surface of the blade unit has not been taken into account in determining the relevant dimensional

BRIEF DESCRIPTION OF THE FIGURES

To further illustrate the invention some forms of razor blade unit shaped and dimensioned in accordance with the invention will now be described with reference to the accompanying drawings, in which.

DETAILED DESCRIPTION OF PREFERRED EMBODIMENTS

Figure 14:
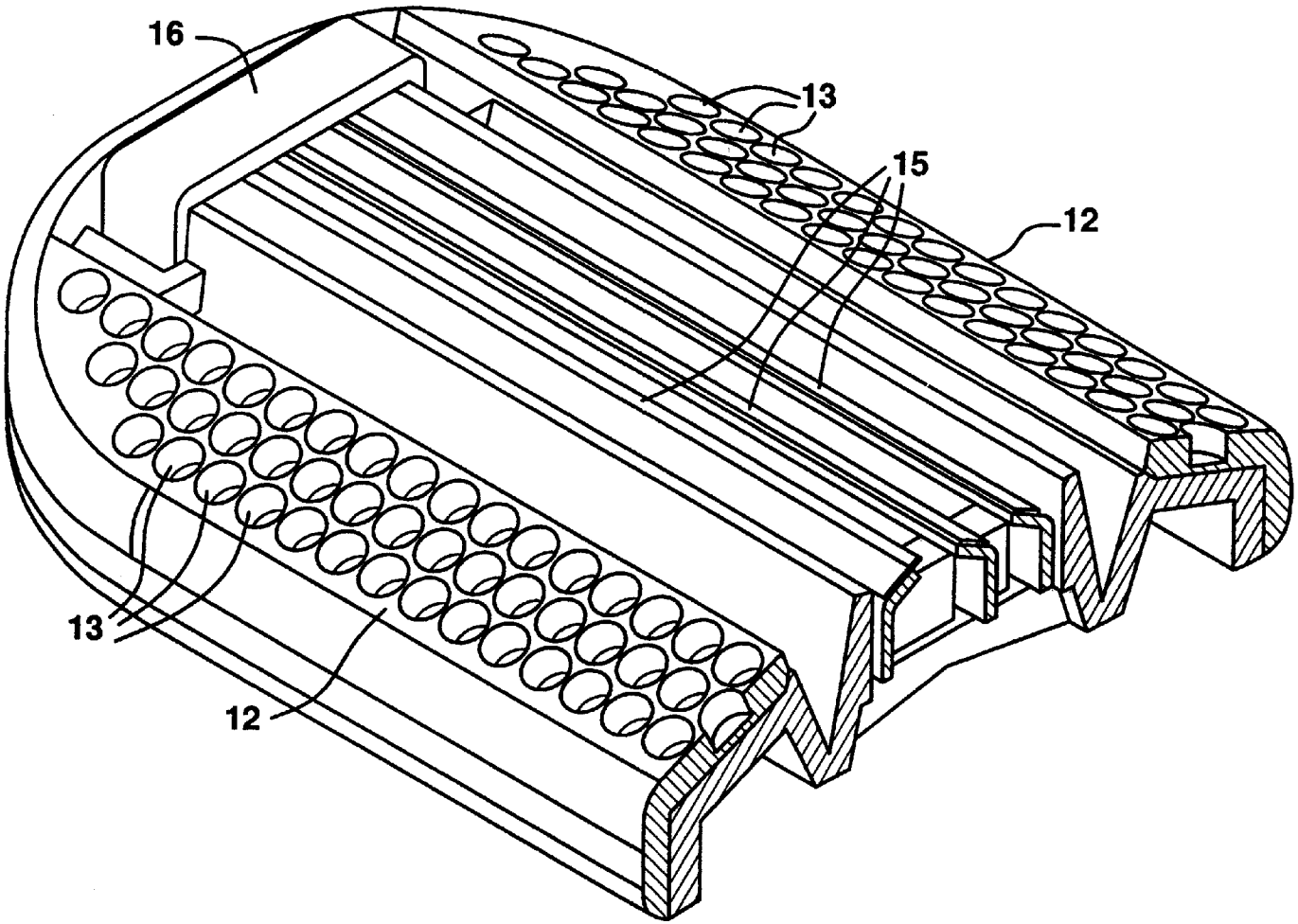
FIG. 14 illustrates in partial perspective view a blade unit as shown in FIG. 1 and having guard and cap surfaces similar to those of the FIG. 13 embodiment.
Figure 15:
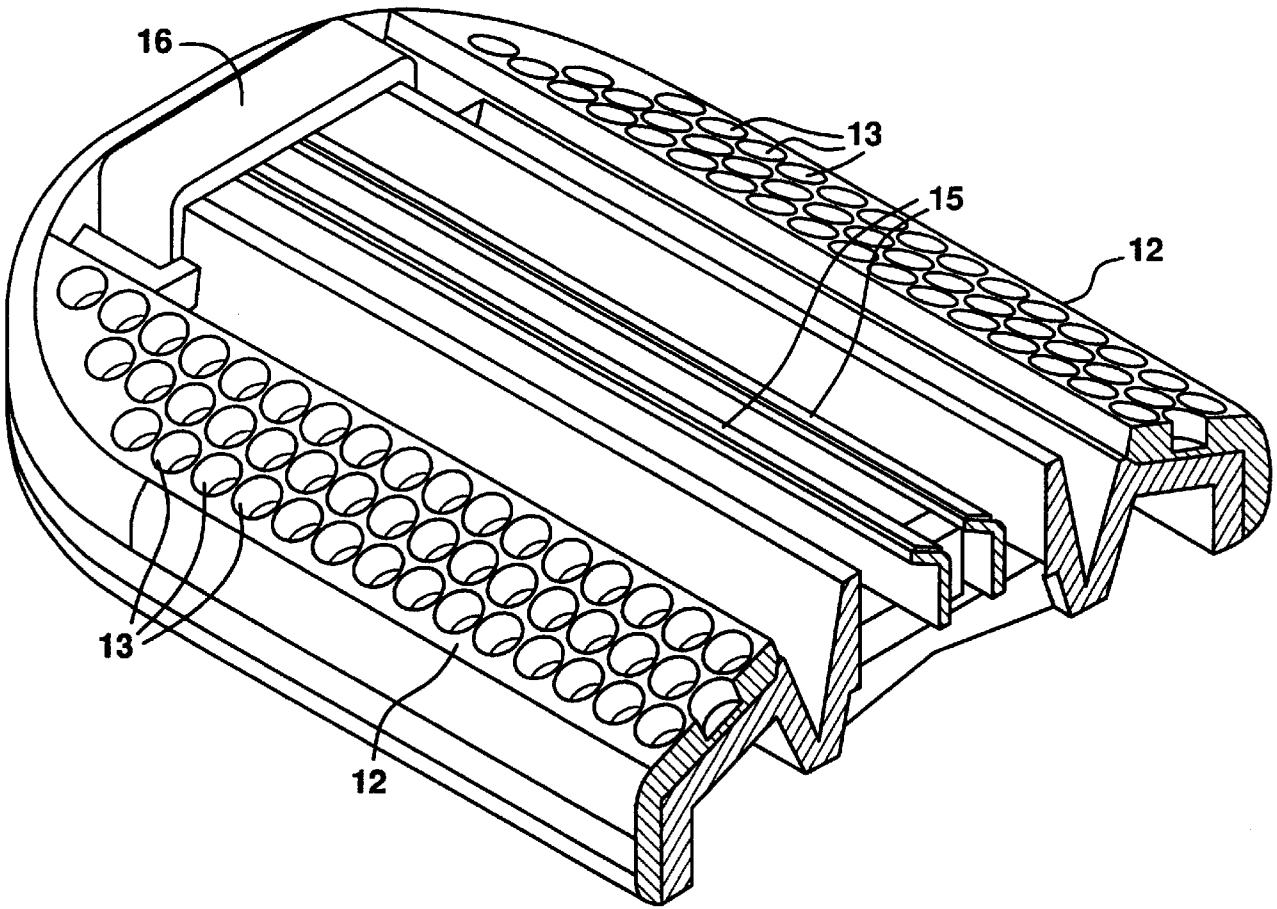
FIGS. 15 and 16 are views corresponding to FIG. 14 showing blade units with two and three forwardly facing blades, respectively.
Figure 16:
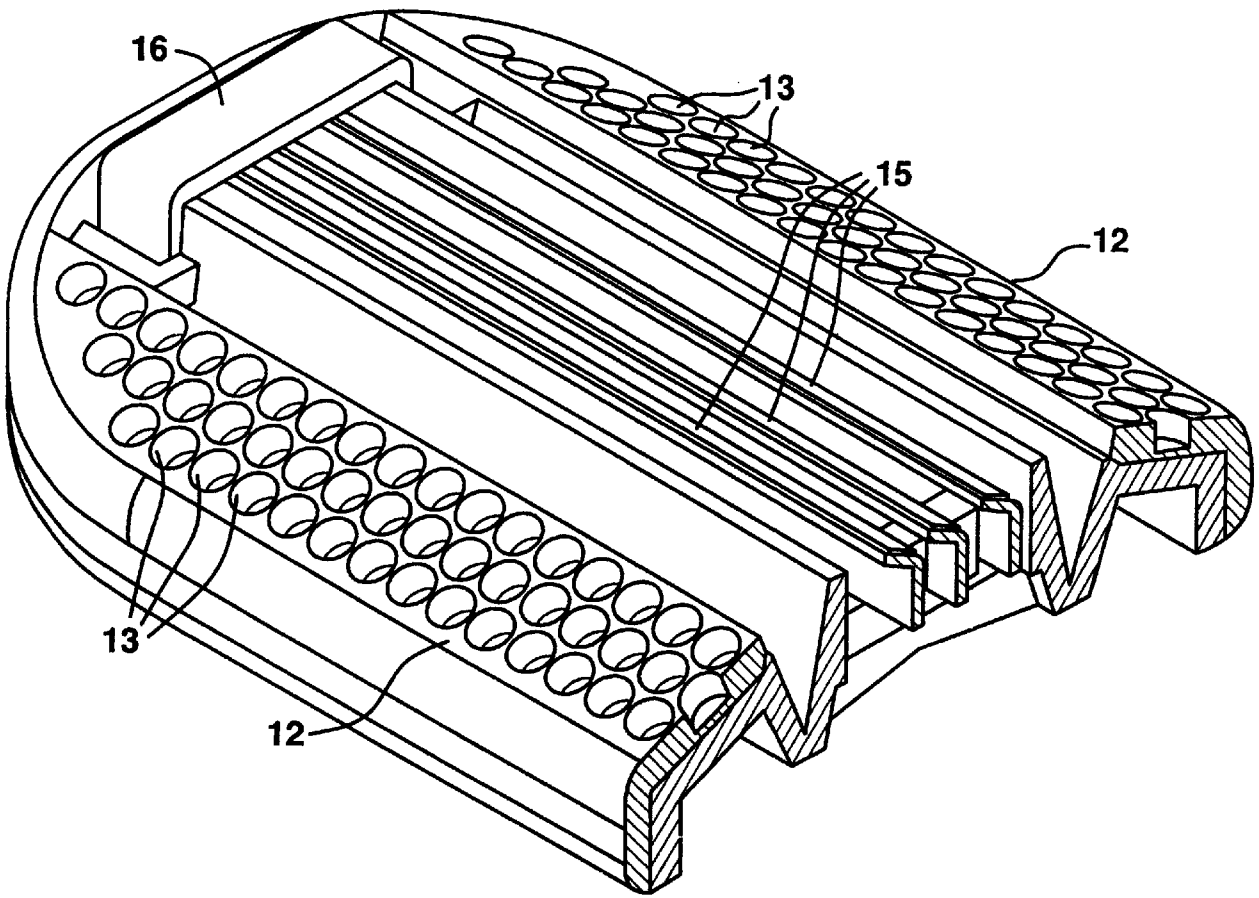
Figure 17:
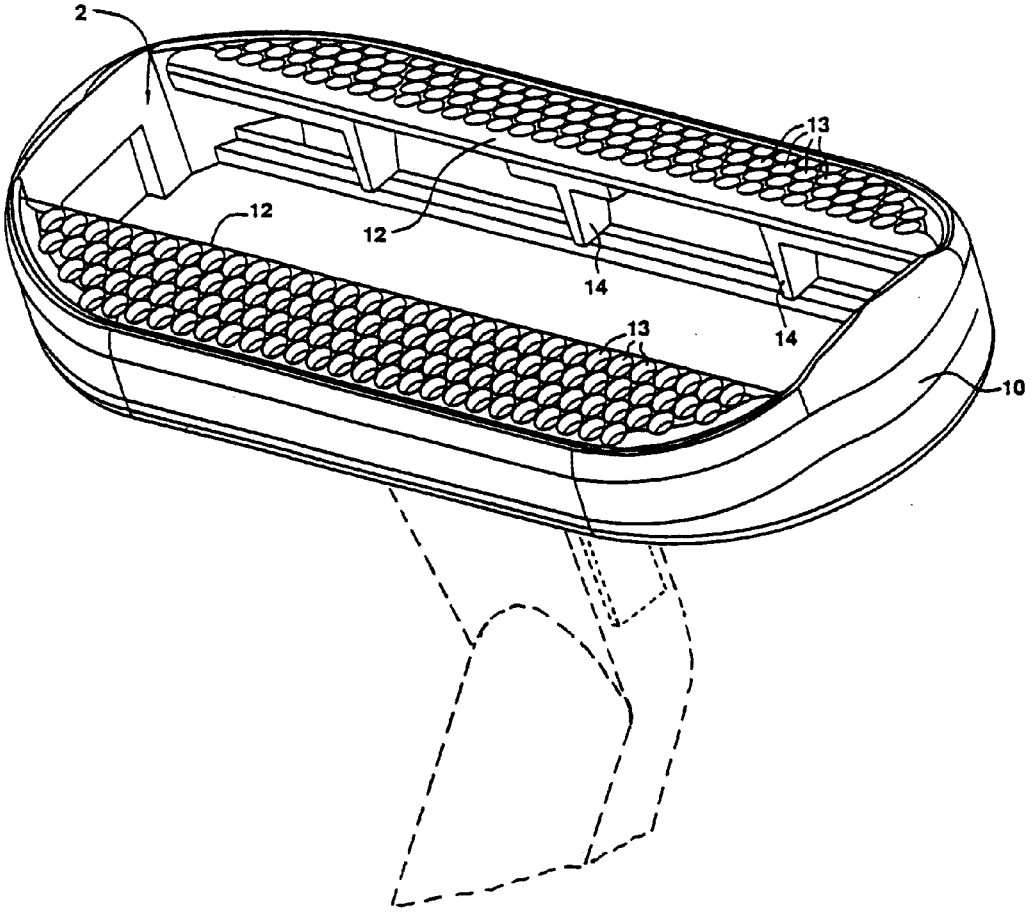
FIG. 17 represents a shaving unit of FIG. 13 on a handle.

Each of the blade units shown in FIGS. 1 to 9 will comprise a blade housing which incorporates a substantially inflexible blade carrier frame conveniently moulded from plastics material. The housing defines a skin contact area surrounding an elongate rectangular aperture 2 in which a blade (not shown in FIGS. 1–9) with a sharp rectilinear edge is mounted. A single blade may be provided, but preferably two or more blades with parallel sharpened edges are mounted in the aperture 2. In the particular embodiment shown in FIG. 14, there are three blades, two facing forwardly and one facing rearwardly so that the razor blade unit will shave in both directions although forward movement across the skin will generally provide a slightly better result. FIG. 15 shows an embodiment with two blades in tandem, and FIG. 16 shows another embodiment with three blades with parallel edges all facing in the forward direction. Each of the blade units of FIGS. 1 to 9 may be regarded as being adapted to receive two blades, or three blades mounted similarly to the blades in FIG. 14 or all in tandem. The blade housing in each of the embodiments shown in FIGS. 1 to 9 has a guard area 3, which is located forwardly (below as viewed in the drawings) of the blade aperture, and a cap area 4 behind (above in the drawings) of the blade aperture 2.

Figure 1:
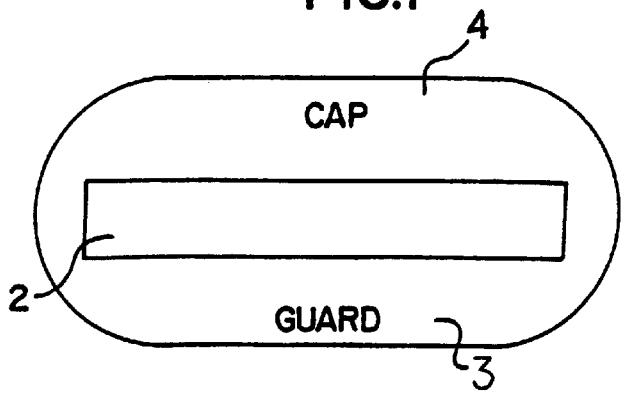
FIGS. 1 to 9 are schematic plan views of razor blade units embodying the invention.

The particular blade unit of FIG. 1 is oval and has the shape of a rectangle with semicircular ends. The dimensions as measured in the projected plan view as illustrated are as follows:

| | |
|---|---|
| Overall length = | 42.0 mm |
| Overall width = | 18.0 mm |
| End radius = | 9.0 mm |
| Guard area = | 206 $mm^2$ |
| Cap area = | 277 $mm^2$ |
| Total skin contact area = | 504 $mm^2$ |
| Total footprint area within perimeter = | 686 $mm^2$ |

Figure 2:
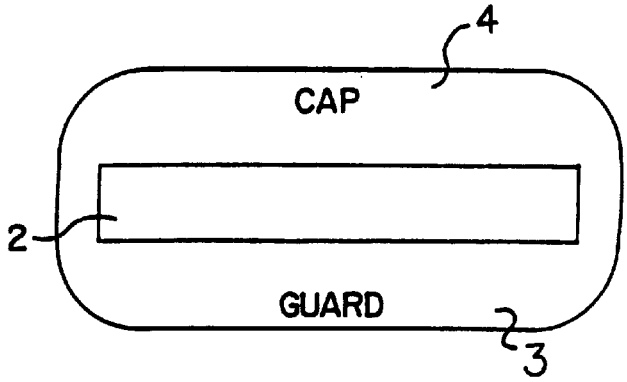

The blade unit of FIG. 2 is approximately rectangular with corners of large radii of curvature. The particular dimensions for this embodiment are:

| | |
|---|---|
| Overall length = | 41.0 mm |
| Overall width = | 18.0 mm |
| Corner radius = | 6.0 mm |
| Guard area = | 213 $mm^2$ |
| Cap area = | 286 $mm^2$ |
| Total skin contact area = | 520 $mm^2$ |
| Total footprint area within perimeter = | 703 $mm^2$ |

Figure 3:
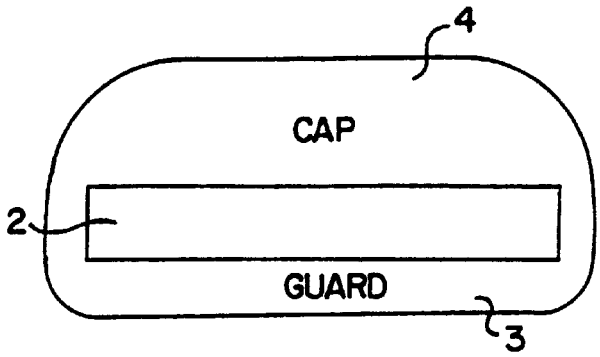

FIG. 3 illustrates a blade unit of asymmetric configuration. At the ends of the front edge of the blade unit housing are rounded corners of large radius (as in ~FIG. 2), and the corners at the ends of the rear edge are rounded with a substantially greater radius of curvature. The specific dimensions are:

| | |
|---|---|
| Overall length = | 40.0 mm |
| Overall width = | 18.0 mm |
| Front end corner radius = | 6.0 mm |
| Rear end radius = | 10.0 mm |
| Guard area = | 185 $mm^2$ |
| Cap area = | 283 $mm^2$ |
| Total skin contact area = | 488 $mm^2$ |
| Total footprint area within perimeter = | 668 $mm^2$ |

Figure 4:
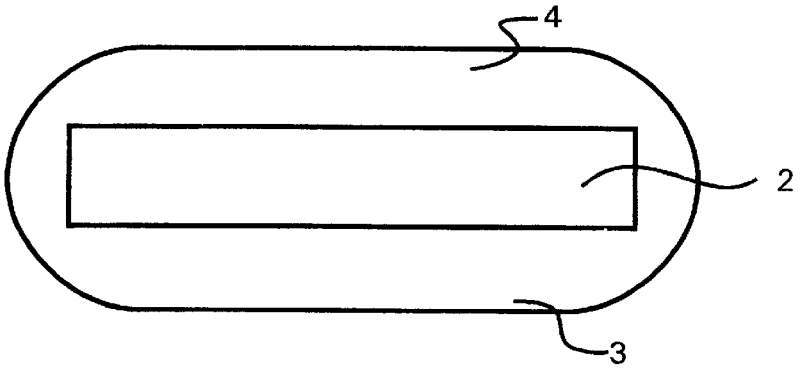
Figure 5:
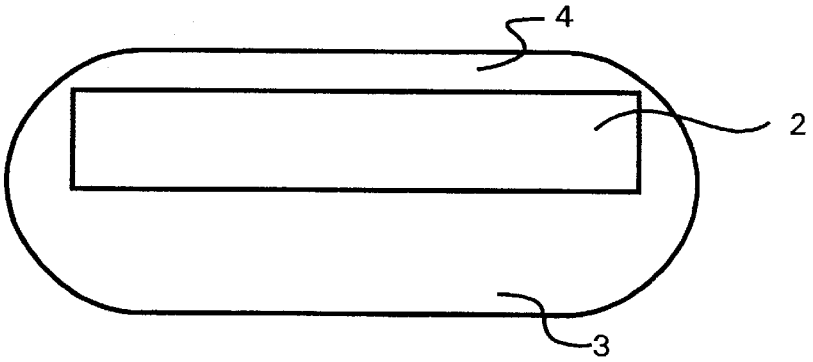
Figure 6:
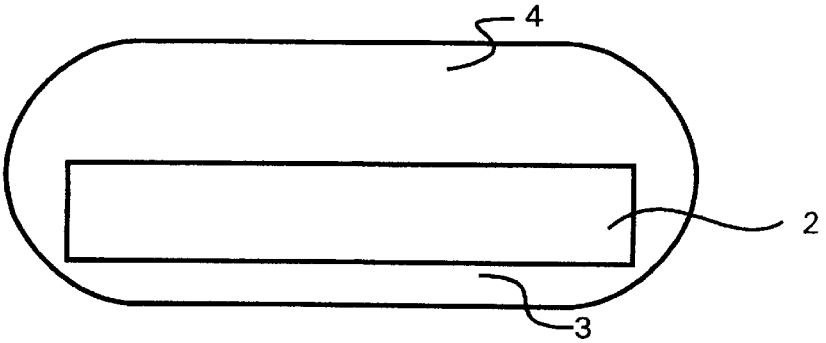

FIGS. 4–6 show blade units with housings of the same overall shape and size of that shown in FIG. 1, but the position of the blade aperture is different. In FIG. 4 the aperture is located so that the guard and cap areas are equal, whereas in FIG. 5 it is positioned so that the cap area is substantially smaller than the guard area (but still at least 140 $mm^2$) and in FIG. 6 it is positioned so that the guard area is substantially smaller than the cap area (but still at least 140 $mm^2$).

Figure 7:
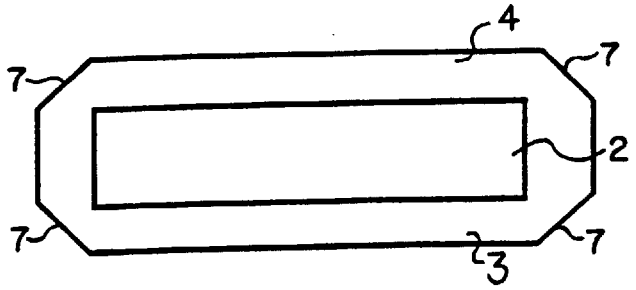

FIG. 7 illustrates a polygononal blade unit shaped essentially as a rectangle with chamfered corners 7 with faces at 135° to the longitudinal front and rear sides and to the ends. In the case of a blade unit of overall length 42 mm and overall width 18 mm, the chamfers may lie along the diagonals of squares measuring 5 mm×5 mm.

Figure 8:
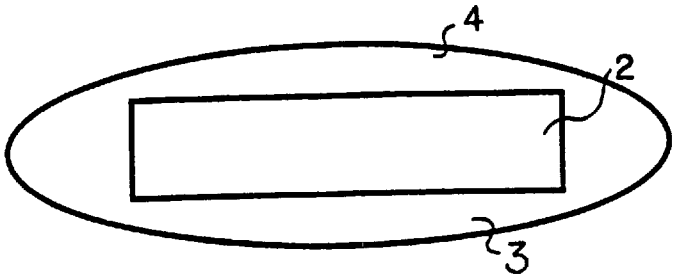
Figure 9:
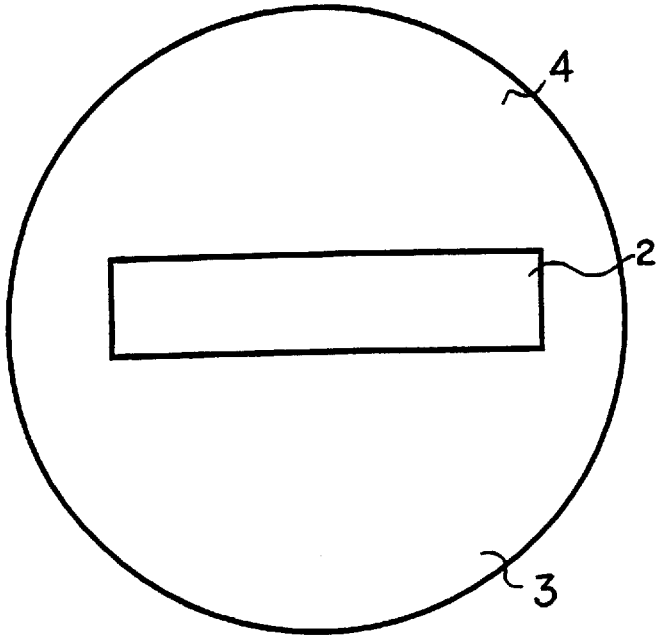

All the embodiments of FIGS. 1–7 have rectilinear front and rear edge portions which, at least over a major part of the blade length are parallel to the blade edge(s). This can be desirable to ease orientation of the blade unit and assist the user in knowing in which direction the blade unit should be moved over the skin. It is not essential, however, and the dimensional criteria of a blade unit embodying the invention can be obtained with other configurations. FIG. 8, for example shows a blade unit of elliptical outline, and even a circular shape as shown in FIG. 9 is possible although it is not the most desirable embodiment.

Figure 10:
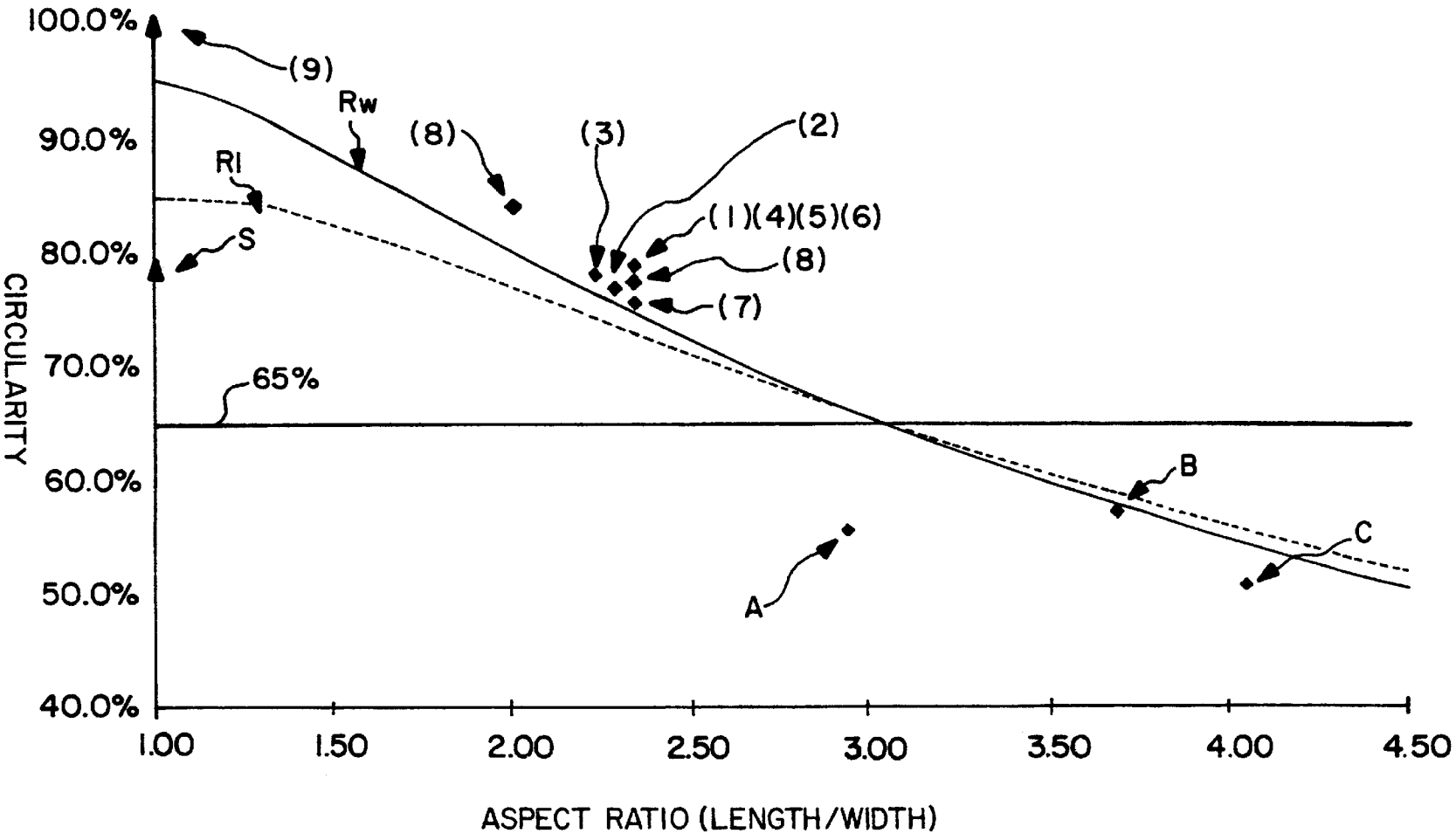
FIG. 10 is a graph showing circularity plotted against aspect ratio (maximum length/maximum width) and showing the results for the blade units of FIGS. 1 to 9 and for some prior art blade units.

FIG. 10 shows a graph showing circularity plotted against aspect ratio, i.e. the maximum length/maximum width of the blade unit. The points representative of the blade units of FIGS. 1–9 are indicated (1) . . . (9), the points representative of three prior art female razor blade units currently marketed are indicated A, B and C, and the point representative of a square is indicated S for comparison purposes. The line $R_W$ which extends generally diagonally across the graph is representative of rectangles with corner radii of 30% of the rectangle width. The dotted line $R_L$ is representative of rectangles with corner radii of 10% of the rectangle length. The horizontal line is drawn at a circularity of 65%. It can be seen that all the preferred embodiments of the invention denoted on the graph have aspect ratios between 1.5 and 2.8, and for the majority the aspect ratio is in the range of 2.0 to 2.5. Furthermore, the embodiments of the invention have circularity greater than the circularity of a corresponding rectangle with the same aspect ratio and having corners rounded at a radius of 10% of the rectangle length ($R_L$) or of 30% of the rectangle width ($R_W$). In addition, the embodiments of the invention have greater circularity than the prior art blade units and those included on the graph all have values above 60%, and more especially above 70%. (It may be noted that there are two points (8) shown in FIG. 10 to depict two alternative elliptical shapes).

Figure 11:
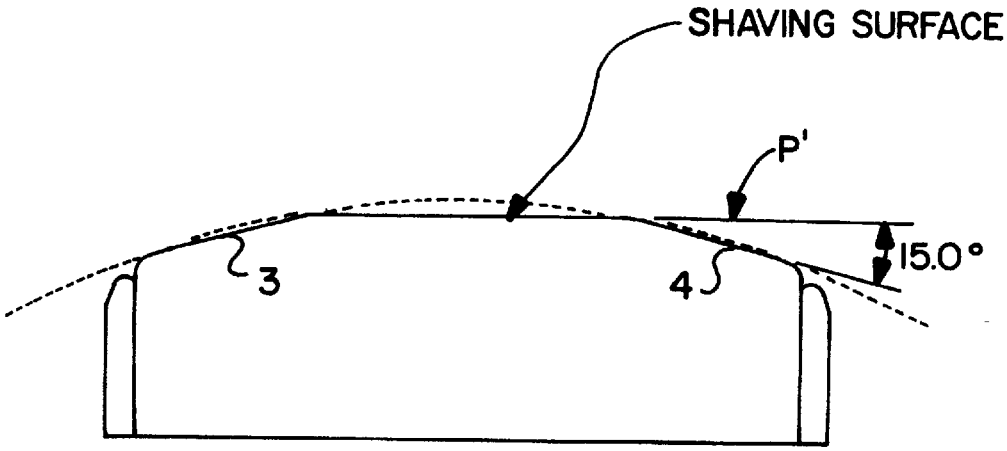
FIG. 11 is a schematic cross-section through the blade unit of FIG. 1.
Figure 12:
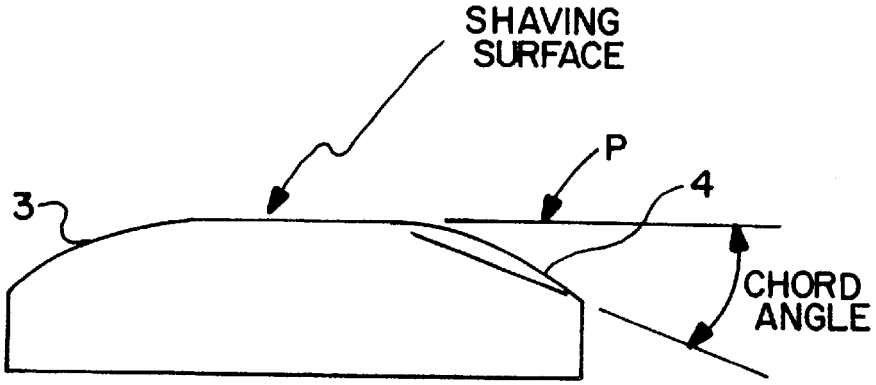
FIG. 12 illustrates a modified shape of guard and cap surfaces for the blade unit of FIG. 1.

In all of the embodiments of the invention the skin contacting surfaces are not flat and the views of FIGS. 1 to 9 are merely the projected plan areas. The surfaces are preferably shaped to make at least three point, and ideally at least four point contact with an imaginary circumscribing circle with a radius of 25 mm. FIG. 11 shows this preferred relationship for a blade which could, for example, be the blade unit of FIG. 1. The imaginary circle is drawn in dotted line, and it can be seen that the cap and guard surfaces are in substantial conformity with this circle. In FIG. 11 the guard and cap surfaces are essentially flat, but they could be convexly curved to provide even closer conformity, e.g. as depicted in the schematic illustration of FIG. 12. The cap and guard surfaces are inclined to a plane P, which is the "shaving surface" tangential to the skin contact surfaces immediately in front of and behind the blade(s), at an angle which is 15° in the exemplary embodiment illustrated. In any particular embodiment the most appropriate inclination angle will depend on the blade unit width and will be chosen accordingly, but for most embodiments of the invention at least, an angle in the range of 10° to 20° will be required to ensure close conformity with the imaginary circle. In the case of a convex guard and/or cap surface, as in FIG. 12, it will be appropriate to consider the inclination of a chord line intersecting the edges of the surface in question nearest and most remote from the adjacent blade.

Figure 13:
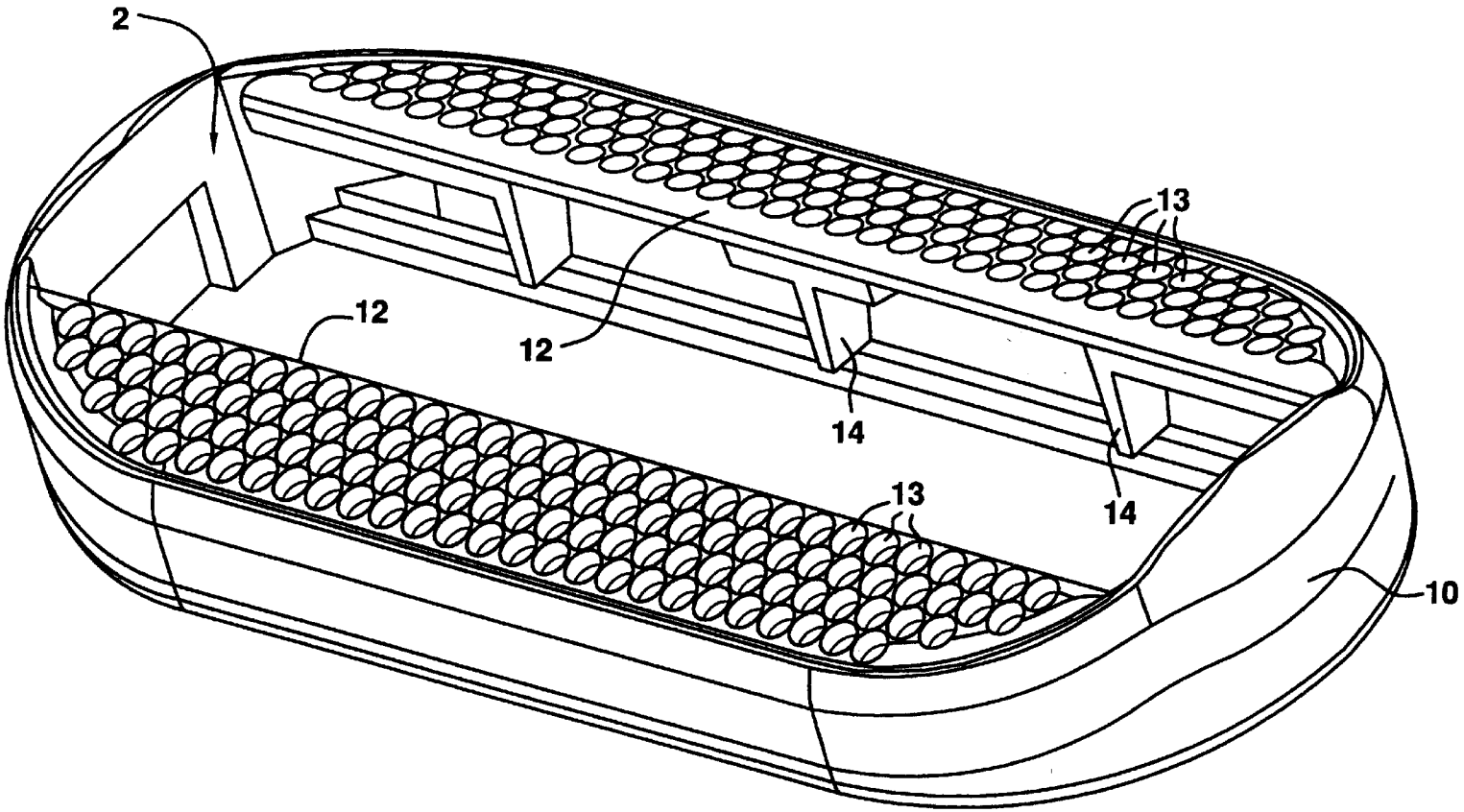
FIG. 13 illustrates in perspective a blade housing of a blade unit as shown in FIG. 1.

In FIG. 13 there is illustrated a preferred form of blade unit housing. It has a frame 10 defining an aperture 2 to accommodate the blades and the components which fix them in the frame. Mounted on the frame are guard and cap components each having an elastomeric surface element 12 defining a skin contact area formed with an array of cylindrical pockets 13 evenly distributed over essentially the entire surface area. For ease of manufacture and assembly the elastomeric element is moulded onto a support 14 which is firmly fastened in the frame 10. FIGS. 14, 15 and 16 show a modified construction wherein the elastomeric elements 12 are carried directly by the frame of the blade unit. These figures also shows the blades 15 fitted within the frames, and one of the securing clips 16 which are provided at each end of the blade unit to retain the blades in place.

It is important to note that, as previously mentioned, all the dimensions quoted in the description and claims of this specification regarding length, width and area are based on the profile of the blade unit skin contacting surface projected onto a plane which is parallel to the plane of the shaving surface i.e. the plane denoted P in FIG. 11. In addition, when calculating the circularity, any minor irregularities in the perimeter, e.g. due to small indentations, such as narrow notches or projections which can significantly change the perimeter without substantially changing the area, should be disregarded.

What is claimed is:

1. A safety razor blade unit comprising a plurality of elongate blades having longitudinally elongate sharpened edges and permanently mounted in spaced relation in a carrier, said carrier comprising a plastics material molding, a skin contacting surface surrounding the blade sharpened edges and including skin-engaging guard and cap surfaces, the skin-engaging guard surface being in front and the skin-engaging cap surface being at the rear of the blade unit, and the plurality of blades being located between the forward guard surface and the rearward cap surface and having the sharpened edges oriented in the same direction facing the guard such that during a shaving stroke the guard surface, the plurality of blade sharpened edges, and then the cap surface sequentially contact the skin, the aspect ratio of the length to width of the skin contacting surface being in the range of from 1:1 to 4:1, as seen in cross section in a plane perpendicular to the blade edges the skin contacting surface being convex, the overall length of the blade unit at the skin contacting surface being not greater than 60 mm, the skin contacting surface having a circumscribing perimeter confining a footprint area of at least 450 $mm^2$, the guard surface having an area of at least 140 $mm^2$ within the footprint area and being at least about 18.6% of said footprint area, and the circumscribing perimeter being so shaped that the footprint area confined by said perimeter has a circularity, wherein circularity (C) is a ratio between the area (A) of a shape enclosed by its perimeter (P) to the length of the perimeter as defined by the relation $C=A/P^2*4\pi*100$, not less than the lower of (a) 65% and (b) the circularity of a substantially rectangular reference area $R_W$ having the same length and width as the footprint area of the skin contacting surface and having corner radii of 30% of said width.

2. A blade unit according to claim 1, wherein the footprint area is in the range of 600 to 750 $mm^2$.

3. A blade unit according to claim 2, wherein the footprint area is between 650 and 720 $mm^2$.

4. A blade unit according to claim 1, wherein the overall length of the blade unit at the skin contacting surface is not greater than 50 mm preferably within the range of 40 to 45 mm.

5. A blade unit according to claim 1, wherein said aspect ratio of length to width is in the range of from 1.5 to 2.8.

6. A blade unit according to claim 5, wherein the aspect ratio is in the range of 2.0 to 2.5.

7. A blade unit according to claim 1, wherein each of the guard and cap surfaces has an area of at least 140 $mm^2$, and at a position where the width of the blade unit is greatest, each of the guard and cap surfaces has a width of at least 4.0 mm.

8. A blade unit according to claim 1, wherein the maximum width of the blade unit is in the range of 12 to 23 mm.

9. A blade unit according to claim 8, wherein the maximum width is in the range of 15 to 20 mm.

10. A blade unit according to claim 1, wherein the combined area of the guard and cap surfaces is at least 400 $mm^2$.

11. A blade unit according to claim 10, wherein the combined area of the guard and cap surfaces is in the range of 450 $mm^2$ to 500 $mm^2$.

12. A blade unit according to claim 1, wherein each of the guard and cap surfaces is convex, so that a line segment passing between inner and outer peripheral regions of each of the respective guard and cap surfaces, the respective inner peripheral region being near to and the respective outer peripheral region being remote from the respective adjacent blade, is inclined downward to a plane tangential to the skin contacting surfaces immediately in front of and behind the blade edges at an angle of inclination of at least 5°.

13. A blade unit according to claim 12, wherein said angle of inclination for each of the guard and cap surfaces is in the range of 10° to 20°.

14. A blade unit according to claim 1, wherein the skin contacting surface is shaped in cross-section to make at least three point contact with an imaginary circumscribing circle of radius 15 to 70 mm.

15. A blade unit according to claim 14, wherein the skin contacting surface is shaped for close conformity with said imaginary circle over the guard and cap surfaces.

16. A blade unit according to claim 1, wherein the area confined by the circumscribing perimeter of the skin contacting surface has a circularity in the range of 70% to 85%.

17. A blade unit according to claim 1, wherein the area confined by the circumscribing perimeter of the skin contacting surface has a circularity greater than that of a substantially rectangular area with the same overall length and width as the skin contacting surface and with corner radii of 10% of the length.

18. A blade unit according to claim 1, wherein the aspect ratio is less than 3, and the circularity of the area confined by the circumscribing perimeter of skin contacting surface is greater than the circularity of a rectangle having the same overall length and width of the skin contacting surface and corner radii of 30% of the width.

19. A blade unit according to claim 1, wherein at least one of the front and rear edges of the blade unit includes a rectilinear portion extending along a major part of the blade edge length and parallel thereto, and smoothly curved corner portions at either end of said rectilinear portion.

20. A blade unit according to claim 19, wherein said corner portions have a radius of curvature at least 6 mm.

21. A blade unit according to claim 19, wherein the blade unit has semi-circular ends.

22. A blade unit according to claim 1, wherein the skin contacting surface has an elliptical profile.

23. A blade unit according to claim 1, wherein the cap and guard surfaces comprise respective elastomeric elements.

24. A blade unit according to claim 23, wherein the elastomeric elements define surfaces with pockets distributed over both said surfaces.

25. A blade unit according to claim 1, wherein the plurality of blades comprises at least three blades mounted in the blade carrier.

26. A blade unit according to claim 1, wherein the guard surface is disposed in spaced relation forward of the plurality of blades.

27. A blade unit according to claim 1, wherein each of the guard and cap surfaces is upwardly convex so that the cap and guard surfaces collectively in lateral cross-section make at least three point contact with an imaginary circumscribing circle.

28. A blade unit according to claim 1, wherein a peripheral edge of the blade unit adjacent the guard surface is free of sharp angled corners.

29. A blade unit according to claim 12, wherein the convex skin contacting surface is smoothly curved.

30. A blade unit according to claim 14, wherein the imaginary circumscribing circle has radius of about 25 mm.

31. A blade unit according to claim 1 in combination with a handle.

32. A blade unit according to claim 1 wherein the blade unit is formed as a cartridge.

33. A blade unit according to claim 1, wherein the skin contacting surface of the carrier has corner radii of at least 5 mm.

34. A blade unit according to claim 1, wherein the guard surface has a region having a width of at least 4 mm, the cap surface is convex, so that a line segment passing between inner and outer peripheral regions of the cap surface, the respective inner peripheral region being near to and the respective outer peripheral region being remote from the blade adjacent the cap surface, is inclined to a plane tangential to the skin contacting surfaces immediately in front of and behind the blade edges at an angle of at least 5° downward toward an underside of the blade unit, and the guard and cap surfaces comprise respective elastomeric elements.

35. A safety razor blade unit comprising a plurality of elongate blades having longitudinally elongate sharpened edges and permanently mounted in spaced relation in a carrier, said carrier comprising a plastics material molding, a skin contacting surface surrounding the blade sharpened edges and including skin-engaging guard and cap surfaces, the skin-engaging guard surface being in front and the skin-engaging cap surface being at the rear of the blade unit, and the plurality of blades being located between the forward guard surface and the rearward cap surface and having the sharpened edges oriented in the same direction facing the guard such that during a shaving stroke the guard surface, the plurality of blade sharpened edges, and then the cap surface sequentially contact the skin, the aspect ratio of the length to width of the skin contacting surface being in the range of from 1:1 to 4:1, as seen in cross section in a plane perpendicular to the blade edges, at least one of the cap and guard surfaces being convex, the overall length of the blade unit at the skin contacting surface being not greater than 60 mm, and the skin contacting surface having a circumscribing perimeter confining a footprint area of at least 450 $mm^2$, the guard surface having an area of at least 140 $mm^2$ within the footprint area and being at least about 18.6% of said footprint area.

36. A blade unit according to claim 35, wherein for the aspect ratio of the length to width of the skin contacting surface not exceeding 3.25:1, the circumscribing perimeter is so shaped that the footprint area confined by said perimeter has a circularity, wherein circularity (C) is a ratio between the area (A) of a shape enclosed by its perimeter (P) to the length of the perimeter as defined by the relation $C=A/P^2*4\pi*100$, not less than 65%.

37. A blade unit according to claim 26, wherein the cap surface is disposed in spaced relation behind the plurality of blades.

38. A blade unit according to claim 1, wherein the blade sharpened edges are rectilinear.

39. A blade unit according to claim 1, wherein said carrier is substantially inflexible.

40. A blade unit according to claim 35, wherein said carrier is substantially inflexible.

41. A blade unit according to claim 1, further comprising a clip retaining the plurality of blades to the carrier.

42. A blade unit according to claim 35, further comprising a clip retaining the plurality of blades to the carrier.

* * * * *